United States Patent [19]

Colan et al.

[11] Patent Number: 4,539,891

[45] Date of Patent: Sep. 10, 1985

[54] SERVO BOOSTER MECHANISM

[75] Inventors: Peter V. Colan; Kenneth L. Miller; Henry P. Tyler, all of South Bend, Ind.

[73] Assignee: Allied Corporation, Morristown, N.J.

[21] Appl. No.: 591,151

[22] Filed: Mar. 19, 1984

[51] Int. Cl.[3] ..... F15B 15/17

[52] U.S. Cl. ..... 91/49; 91/376 R; 91/417 R

[58] Field of Search ..... 91/49, 417 R, 376 R

[56] References Cited

U.S. PATENT DOCUMENTS

| | | | |
|---|---|---|---|
| 1,585,529 | 5/1926 | Bouing | 91/49 |
| 3,514,072 | 5/1970 | Tutherly | 91/49 |
| 3,757,640 | 9/1973 | Karol | 91/49 |

*Primary Examiner*—Paul E. Maslousky

*Attorney, Agent, or Firm*—Leo H. McCormick, Jr.; Ken C. Decker

[57] ABSTRACT

A servo booster mechanism (18) having a piston (48) responsive to movement of a plunger (84) by an input signal for controlling the rate of fluid flow past a seat (82) into a passage (80) for distribution to the surrounding environment. A first restrictor (75) creates a first pressure drop in a supply fluid pressure $P_s$ to present an operational chamber (46) with fluid at a pressure $P_x$. A second restrictor (openings 74–76) creates a second pressure drop in fluid pressure $P_x$ supplied from the operational chamber (46) to present control chamber (88) with fluid at a pressure $P_h$. The difference in pressures combine to act on the piston (48) and plunger (84) to provide a constant force at stem (26), which provides a feedback to the input member (12), and provide a linkage (22) with a force to hold a position sensor (24) in a stationary position.

11 Claims, 1 Drawing Figure

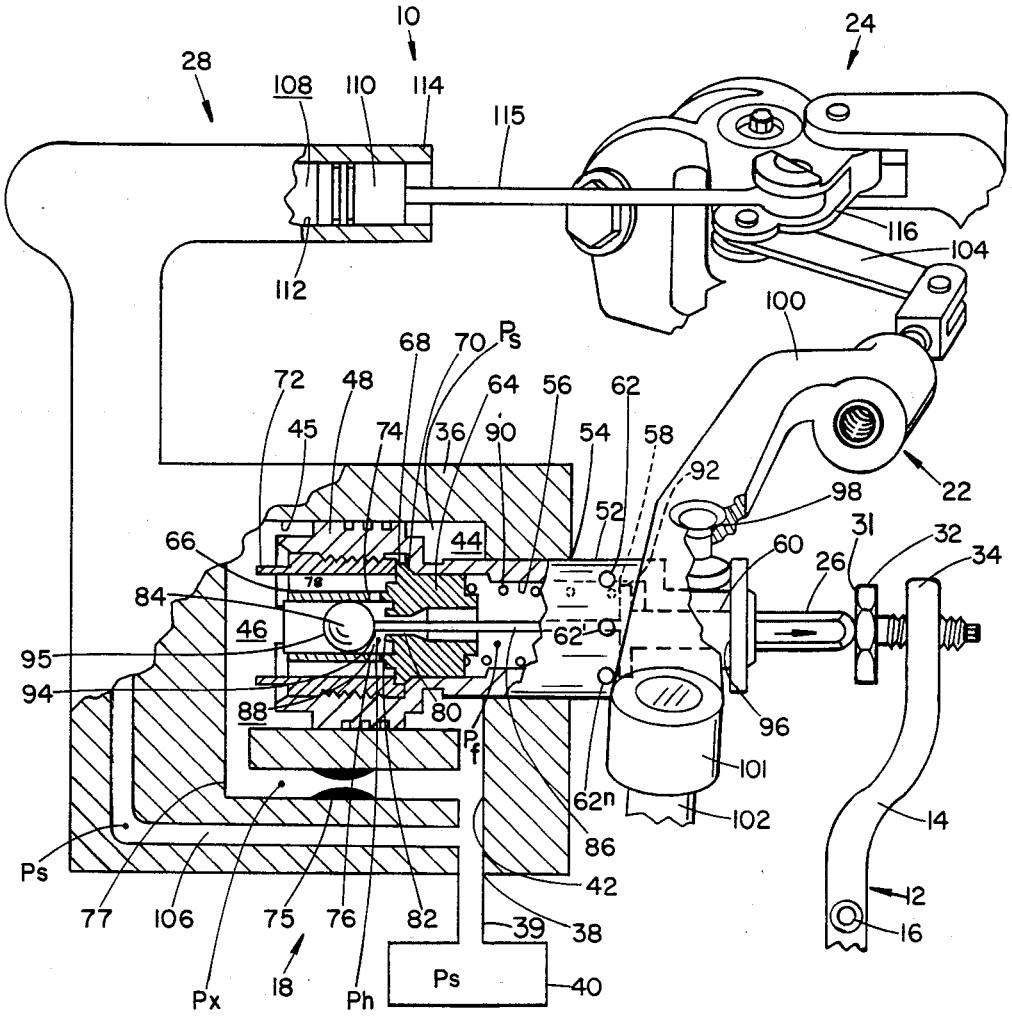
10
24
28
108
110
114
115
116
104
112
100
68
70
Ps
72
48
64
56
62
45
74
36
90
54
58
92
98
22
52
31
32
66
44
60
26
34
84
46
62
95
94
88
80
96
Pf
101
62n
102
14
86
Ps
42
12
77
106
75
76
82
39
38
16
Px
18
Ph
Ps
40

SERVO BOOSTER MECHANISM

This invention relates to a servo booster mechanism having a housing with a valve therein for controlling the flow of fluid from a source to the surrounding environment to develop an operational pressure differential across a piston which provides an input to a corresponding linkage connected to a receiver member.

Servo valve systems of the type disclosed in U.S. Pat. No. 3,745,833 have been used to provide fluid to operate devices such as pistons wherein the piston movement controls a load such as the operation of a motor. In such systems, an input mechanism controls a valve which enables fluid under pressure to be supplied to operate the piston. Unfortunately a feedback device in such servomotor systems may under some conditions induce piston instability. Such instability could reduce the smooth operation of the motor or possibly induce loads on some of the parts in the system above design loads, creating a potential hazard.

The servo booster mechanism of the present invention is characterized by a fluid flowing through a control mechanism from a source to the surrounding environment. A piston divides the interior of the control mechanism into a first chamber and a second chamber. The piston has a projection with a bore therein connected to the surrounding environment. A cylindrical member located in the bore cooperates with the piston to define an annular flow path that terminates adjacent a pair of radial orifices that lead to a passage which connects the second chamber with the bore. An annular rib located in the passage adjacent the radial orifices establishes a seat. A valve plunger located in the passage and the cylindrical member defines a valve chamber that is connected to the radial orifices. An input member attached to the valve plunger positions a face on the plunger with respect to the seat to control or restrict flow of fluid from the valve chamber to the surrounding environment.

During operation a conduit connects a first chamber to a source of fluid under pressure $P_s$. A passage connects the first chamber to the second chamber. A restriction in the passage reduces the fluid pressure of the fluid from the supply pressure $P_s$ in the first chamber to a fluid pressure $P_x$ in the second chamber. As the fluid flows from the second chamber through the radial orifices the fluid pressure $P_x$ is further reduced to a fluid pressure $P_h$ in the valve chamber. The fluid pressure differential between the first and second chambers $(P_s-P_x)$ acts on and moves the piston with respect to the housing. At the same time the pressure differential $(P_x-P_h)$ acts on the plunger and the pressure differential $(P_x-P_f)$ acts on the stem of the plunger. When the forces produced by the pressure differentials are combined, the piston moves to position corresponding to an input signal request supplied to the valve plunger. At all such positions a controlled volume of fluid flows through the annular rib to maintain a balanced condition with the input signal.

An advantage of this invention occurs through the dampening of the piston oscillations by the pumping effect on the plunger area with plunger motion relative to piston motion.

A further advantage occurs through the development of a positive hydraulic rate that develops across the plunger area to sustain stability or other desired operational characteristics.

It is an object of this invention to provide a servo booster mechanism with the structure for sequentially reducing the fluid pressure of fluid from a source to create a plurality of pressure differentials which collectively act on a piston and valve assembly to control the position of an output member in response to movement of an input member.

These advantages and objects should be apparent from reading this specification while viewing the drawings.

The invention will now be described with reference to the accompanying drawing wherein a schematic illustration of a system with a sectional view of a servo booster mechanism.

The system 10 shown in the drawing has an input member 12 with a lever arm 14 pivotally attached to pin 16, a servo booster mechanism 18 connected to the input member 12 by push rod 26, linkage 22 connected to the servo booster mechanism 18, a position sensor 24 connected to the linkage 22 and a linkage tightner 28 for urging the linkage 22 into engagement with the servo booster mechanism 18.

In response to an input applied to lever arm 14, push rod 26 activates the servo booster mechanism 18 which correspondingly moves linkage 22 to position sensor 24.

In more particular detail the various components and their relationship with each other is as follows:

The input member 12 includes the lever arm 14 which is fixed to pin 16 and an adjustment screw 32. The adjustment screw 32 can be moved with respect to end 34 of the lever 14 to change the relationship thereof with respect to push rod 26.

The servo booster mechanism 18 has a housing 36 with a bore or cavity 45 therein. Housing 36 has an entrance port 38 that connects a source 40 of fluid under pressure $P_s$ to a supply passage 42. The cavity or bore 45 is divided into a first chamber 44 and a second chamber 46 by a piston 48. Piston 48 has a projection 52 that extends through an opening 54 in housing 36. Piston 48 has a stepped bore 56 that extends therethrough to a shoulder 58 where the diameter thereof is reduced to bore 60. A series of openings 62, 62'. . . 62$^N$ connect bore 56 with the surrounding environment.

A cylindrical body 64 located in bore 56 of piston 48 has a rib 68 held against shoulder 70 by a fastener 72. A sleeve member 66 extends from the cylindrical body 64 toward chamber 46. Sleeve member 66 and fastener 72 form a flow path 78 from chamber 46 to a valve chamber 88. Sleeve member 66 has a series of restricting orifices 74 and 76 which control the fluid communication from chamber 46 through the flow path 78 to chamber 88. Cylindrical body 64 has a central passage 80 therethrough for connecting bore 56 with an annular seat 82 adjacent chamber 88.

Push rod 26 is connected to a valve plunger 84 by a stem 86. Valve plunger 84 has a spherical or ball shape. Plunger face 94 and sleeve member 66 define the size of chamber 88 adjacent seat 82. A spring 90 located between cylindrical member 64 and retainer 92 attached to stem 86 urges face 94 on plunger 84 toward seat 82 to restrict the flow through passage 80 and create a pressure drop between chamber 88 and bore 56.

Projection 52 has a groove 96 adjacent the end thereof which retains pins 98 (only the top one is shown) on lever 100 of linkage 22. Lever 100 which is fixed to pivot pin 102 is attached to arm 104 of a position sensor 24.

Input or supply port 38 in housing 36 has a conduit or passage 106 which supplies fluid to chamber 108 in linkage tightener or tensioner 28. A piston 110 located in bore 112 of housing 114 has a stem 115 attached to yoke 116 of the position sensor 24. The fluid pressure in chamber 108 acts on piston 110 to provide a force that holds position sensor 24 in such a position that the input that is transmitted through lever 100 of linkage 22 corresponds at all times to the location of piston 48 within bore 45.

In operation fluid having a supply pressure $P_s$ is communicated from source 40, usually a pump, through a conduit 39 to inlet port 38. On entering passage 42, supply fluid is simultaneously transmitted to chambers 44 and 108. In chamber 108 the fluid pressure $P_s$ acts on piston 110 to supply position sensor 24 with an input via yoke 116. At the same time the fluid pressure $P_s$ in chamber 44 acts on the effective area of piston 48 (diameter of piston 48 less diameter of projection 52), the fluid pressure $P_x$ in chamber 46 (pressure of the supply fluid $P_s$ reduced by the flow restrictor 75 in passage 77) acts on the effective area of piston 48 (diameter of piston 48 less the diameter of plunger 84) and the fluid pressure $P_h$ in chamber 88 (fluid pressure $P_x$ reduced by the flow restrictors 74 and 76) acts on face 94 of plunger 84 less the area of stem 86. The forces generated by the differential in fluid pressure within housing 36 holds piston 48 in a stationary position such that fluid continually flows from supply 40 to the surrounding environment by way of the following flow path, conduit 39, passage 42, passage 77, chamber 46, flow path 78, orifices 74 and 76, chamber 88, seat 82, passage 80, bore 56 and openings 62, 62'. . . 62$^N$.

In response to input force applied to input member 12, lever 14 pivots on pin 16 to provide linear movement for end 34. Movement of end 34 is transmitted into push rod 26 through the face 31 on adjustment screw 32 to move face 94 away from seat 82 and allow fluid to flow from chamber 88 at a different rate to reduce the fluid pressure $P_h$ therein to a different fluid pressure $P_h+1$. When the fluid pressure $P_h$ changes, the fluid flow through orifices 74 and 76 also changes to change the fluid pressure $P_x$ in chamber 46 to $P_x+1$. Since the fluid pressure in chamber 44 remains at the supply pressure $P_s$, an unbalanced pressure differential is created across piston 48. This pressure differential $P_s-P_x+1$ acts on the effective area of piston 48 to move the piston 48 back to a balance condition where the forces acting on the piston 48 again allow a predetermined volume of fluid to flow past seat 82 of passage 80. As piston 64 moves an input force is transferred through pins 98 into arm 100 of linkage 22. Since arm 100 is pivoted at end 101 movement of piston 64 is amplified and provides arm 104 with an input that is transferred to position sensor 24.

When the input signal applied to input member 12 changes, such that piston 48 moves toward chamber 44 in the drawing, return spring 90 acts on stem 86 to urge face 94 toward seat 82 and reduce the flow of fluid through passage 80. With fluid flow through passage 80 restricted, the fluid pressure $P_x$ in chamber 46 immediately increases to $P_x+1$ and approaches the pressure $P_s$ in the supply fluid. Since the effective area of piston 48 in chamber 46 is greater than the effective area in chamber 44, piston 48 moves toward chamber 44. At some point corresponding to an input operational signal, lever arm 14 stops, correspondingly push rod 26 and plunger 84 also come to a stationary position within bore 45. As face 94 of plunger 84 moves toward seat 82, the fluid pressure in chamber 88 increases to $P_h+1$ and approaches $P_x+1$. However, the fluid pressure $P_f$ in passage 80 and bore 56 remain essentially at that of surrounding environment. When plunger 84 stops and piston 48 continues to move, fluid in chamber 88 can now flow essentially unrestricted through passage 80 into bore 56 for distribution to the surrounding environment. As fluid flows from chamber 88, the fluid pressure $P_h+1$ therein and the fluid pressure $P_x+1$ in chamber 46 is reduced. At some point in time when the fluid pressure $P_x+1$ in chamber 46 again reaches fluid pressure $P_x$ or the equivalent pressure, the fluid pressure in chamber 88 is again $P_h$. With fluid of pressure $P_x$ in chamber 46 directly acting on face 95 of plunger 84 (since $P_x$ acting on face 95 is always greater than the fluid pressure $P_h$ in chamber 88 acting on face 94), the relationship between this pressure on face 95 and $P_h$ pressure acting on face 94 results in a force which acts to produce a smooth movement of piston 48 without creating oscillations. If such oscillations were allowed to develop they would be amplified in linkage 22 and transferred into position sensor 24. By matching the size of the first restrictor 75 with the size and/or number of orifices 74 and 76 which act as a restrictor control the pressure drop between chambers 46 and 88 as the pressure drops from $P_x$ to $P_h$, a controlled hydraulic rate of the servo system can be achieved.

We claim:

1. In a system having a servo booster mechanism through which an input signal is modified to produce a corresponding output signal for moving a linkage to supply a device with an operational input, said servo booster mechanism being characterized by a housing having a cavity therein;

piston means located in said cavity for establishing first and second chambers therein, said piston means having a projection that extends through said housing, said projection having a first bore therein connected to a surrounding environment, said projection being connected to said linkage;

a cylindrical member located in said first bore, said cylindrical member having a second bore therein for connecting said second chamber with the first bore, said cylindrical member having an annular seat that surrounds a central opening and a control orifice through which fluid from said second chamber flows into said second bore;

conduit means connected to a source of fluid under pressure ($P_s$) having a first branch connected to said first chamber and a second branch connected to said second chamber;

first restrictor means located in said second branch to create a pressure drop in said fluid presented to said second chamber to create a fluid pressure ($P_x$);

valve means located in said second bore, said valve means cooperating with said cylindrical member to define a third chamber within said second bore, said control orifice being connected to said third chamber and said third chamber being connected to said first bore through said central opening, said valve means having a plunger with a second face exposed to a fluid pressure $P_h$) in said third chamber and a first face exposed to the fluid pressure ($P_x$) in said second chamber, the relationship of said first face and annular seat controlling the flow of fluid from said third chamber into said first bore for communication to said surrounding environment, said input signal moving said plunger to change the relationship between said first face and annular seat to allow fluid to flow from said third chamber and change the fluid pressure therein from $P_h$ to $P_h-1$, said change in the fluid pressure $P_h$ in said third chamber producing a corresponding change in the fluid pressure $P_x$ in said second chamber to $P_x-1$ to create a pressure differential $(P_s-P_x-1)$ across said piston means, said pressure differential $(P_s-P_x-1)$ acting on and moving said piston means to produce said output signal, said piston means on moving reestablishing the $P_x$ fluid pressure in the second chamber whereby the pressure differential $(P_s-P_x)$ acts on and holds the piston means stationary to reestablish the relationship between said first face and annular seat whereby a substantially constant volume of fluid flows from said third chamber to the surrounding environment by way of said first bore.

2. In the system as recited in claim 1 wherein said piston means is further characterized by the fluid pressure $P_x$ in said second chamber acting on said second face to provide a feedback indication of the output force supplied to said device.

3. In the system as recited in claim 2 wherein said projection of said piston means is characterized by a series of openings that regulate the flow of fluid from said first bore to the surrounding environment to control the development of the pressure $P_h$ in said third chamber.

4. In the system as recited in claim 3 wherein said valve means is further characterized by a push rod that extends through said piston means and is connected to said plunger; and a resilient member connected to said push rod for providing a constant force that urges said second face toward said annular seat.

5. In the system as recited in claim 4 wherein said projection on said piston means is characterized by a groove that receives a drive pin on said linkage, said projection transmitting said output signal to said linkage through said drive pin.

6. In the system, as recited in claim 5 wherein said servo booster mechanism is further characterized by a second housing having a bore therein connected to said source of fluid under pressure $(P_s)$ and a piston in said bore, said pressure $(P_s)$ acting on said piston to create an output force, said output force being transferred into said linkage to provide a loading force to assure that said drive pin remains in constant engagement with said groove.

7. In the system as recited in claim 4 wherein said valve means is further characterized by a retention member that engages said piston means to hold said cylindrical member in a fixed position to locate said annular seat with respect to said plunger.

8. A servo booster mechanism comprising:

a housing having a cavity therein with an inlet port connected to a source of fluid at a first pressure $(P_s)$;

a piston for dividing said cavity into a first chamber and a second chamber, said piston having a projection that extends through the housing, said projection reducing the effective area $(A_1)$ of said piston in said first chamber as compared to the effective area $(A_2)$ in said second chamber, said piston and projection having a bore therethrough connected to a surrounding environment, said inlet port being connected to said first chamber;

conduit means for connecting said inlet port with said second chamber;

a first restrictor located in said conduit means for modifying the fluid pressure $(P_s)$ supplied to said second chamber to produce a fluid pressure $(P_x)$ in said second chamber;

a cylindrical member located in said bore and having a passage therein for connecting said second chamber with said bore, said cylindrical member having an annular seat surrounding a section of said passage;

a second restrictor located in said passage for modifying the fluid pressure $(P_x)$ supplied to said bore to produce a fluid pressure $(P_h)$ in said passage;

valve means located in said bore having a plunger, said valve means being responsive to an input signal for moving said plunger with respect to said annular seat to modify the fluid flow to said bore which results in a change in the fluid pressure in said passage from $(P_h)$ to $(P_{h1})$and in said second chamber from $(P_x)$ to $(P_{x1})$, with the fluid pressure $(P_{x1})$ in the second chamber and the fluid pressure $(P_s)$ in the first chamber a pressure differential $(P_s-P_{x1})$ is created across said piston, said fluid pressure $(P_s)$ acting on the effective area $(A_1)$ and fluid pressure $(P_{x1})$ acting on the effective area $(A_2)$ causing said piston to move and reestablish the fluid flow relationship through said annular seat and return the fluid pressure therein to $(P_h)$ and dissipate the pressure differential across said piston as the fluid pressure in the second chamber returns to $(P_x)$, said piston on moving providing a receptive member with an output signal corresponding to the movement of said projection with respect to said housing.

9. The servo booster mechanism as recited in claim 8 wherein said plunger has a first face exposed to the fluid pressure $(P_x)$ in the second chamber and a second face exposed to the fluid pressure $(P_h)$ in said passage, the difference between fluid pressure $(P_x)$ and $(P_h)$ creating a second pressure differential that urges said second face toward said annular seat to maintain a desired hydraulic rate.

10. The servo booster mechanism, as recited in claim 9 wherein said input signal moves said plunger to a fixed position and said pressure differential $(P_s-P_x-1)$ moves said piston to a corresponding fixed position where a pressure differential of $(P_h-P_f)$ allows a controlled flow of fluid to continuously be communicated from said passage to the surrounding environment.

11. The servo booster mechanism, as recited in claim 10 wherein the fluid flow in said passage is restricted to dampen any oscillation movement of said plunger in response to movement of said piston.

* * * * *